US005537009A

United States Patent [19]

Chukanov

[11] Patent Number: 5,537,009

[45] Date of Patent: Jul. 16, 1996

[54] TRANSITION OF A SUBSTANCE TO A NEW STATE THROUGH USE OF ENERGIZER SUCH AS RF ENERGY

[76] Inventor: Kiril B. Chukanov, 1333 Gough St., 7E, San Francisco, Calif. 94109

[21] Appl. No.: 260,483

[22] Filed: Jun. 15, 1994

Related U.S. Application Data

[63] Continuation of Ser. No. 173,153, Dec. 22, 1993, abandoned, which is a continuation of Ser. No. 32,424, Mar. 16, 1993, abandoned, which is a continuation of Ser. No. 960,243, Oct. 13, 1992, abandoned, which is a continuation of Ser. No. 845,732, Mar. 2, 1992, abandoned, which is a continuation of Ser. No. 592,198, Oct. 3, 1990, abandoned.

[51] Int. Cl.[6] ..... H05B 41/16

[52] U.S. Cl. ..... 315/248; 315/110; 315/363

[58] Field of Search ..... 315/108–110, 111.01, 315/111.91, 363, 248; 250/288

[56] References Cited

U.S. PATENT DOCUMENTS

| | | | |
|---|---|---|---|
| 4,019,091 | 4/1977 | Schoenmakers | 315/110 |
| 4,598,231 | 7/1986 | Matsuda | 315/111.91 |
| 4,912,324 | 3/1990 | Clark | 250/288 |

OTHER PUBLICATIONS

Horiuchi, R., et al., "Three–Dimensional Self–Organization of a Magnetohydrodynamic Plasma," Phys. Rev. Lett. 55 (2), 211–213 (1985).

King, M. B., "Macroscopic Vacuum Polarization," Proceedings of the Tesla Centennial Symposium, International Tesla Society, Colorado Springs, pp. 99–107 (1984).

Boyer, T. H., "Random Electrodynamics: The Theory of Classical Electrodynamics with Classical Electromagnetic Zero–point Radiation," Phys. Rev. D11, No. 4 790–808 (1975).

Senitzky, I. R., "Radiation–Reaction and Vacuum Field Effects in Heisenberg–Picture Quantum Electrodynamics," Phys. Rev. Lett. 31 (15) 955–958 (1973).

Johnson, P. O., "Ball Lightning and Self–Containing Electromagnetic Fields," Am. J. Phys. 33, pp. 119–123 (1965).

Singer, S., "The Nature of Ball Lightning," Plenum Press, NY (1971).

King, M. B., "Tapping the Zero–Point Energy," 1989, pp. 7–10 (Paraclete Publishing, P.O. Box 859, Provo, UT 84603).

Secor, H. W., "The Tesla High Frequency Oscillator," Electrical Experimenter 3, pp. 614, 615 and 663 (1916).

Puthoff, H. E., "Gravity as a Zero–Point Fluctuation Force," Phys. Rev. A 39(5), pp. 2333–2342 (1989).

*Primary Examiner*—Robert J. Pascal
*Assistant Examiner*—Michael B. Shingleton
*Attorney, Agent, or Firm*—Cooper & Dunham

[57] ABSTRACT

A material such as a gas at an initial pressure below atmospheric is treated with RF energy at a frequency greater than 1 MHz to transition to a glow discharge state and then at increased pressure to a new state at which the average internal temperature is at least an order of magnitude higher than in the glow discharge state but the rate or radiating heat is at least an order of magnitude lower than in the glow discharge state. The new state can be maintained for a period of the order of at least tens of seconds and energy can be extracted through contacting the gas in the new state with a heat conducting body. In variations, the gas pressure need not be below atmospheric, materials in liquid and solid phases can be used in place of the gas, and energizers other than RF energy can be used, such as high-voltage discharges and high-energy particle beams.

10 Claims, 2 Drawing Sheets

36a
36b
WAVE GENERATOR
36
34
30a
32
10a
10b
12
14
16
18
20
22
Water Source
Vaccum Control
11
30
10
38
24
26
28
Heated Water Utilization Device

TRANSITION OF A SUBSTANCE TO A NEW STATE THROUGH USE OF ENERGIZER SUCH AS RF ENERGY

This is a continuation of application Ser. No. 08/173,153 filed Dec. 22, 1993 now abandoned, which in turn is a continuation of application Ser. No. 08/032,424 filed Mar. 16, 1993, now abandoned which in turn is a continuation of application Ser. No. 07/960,243 now abandoned filed Oct. 13, 1992, which in turn is a continuation of application Ser. No. 07/845,732 filed Mar. 2, 1992, now abandoned which in turn is a continuation of application Ser. No. 07/592,198 filed Oct. 3, 1990 now abandoned.

BACKGROUND AND SUMMARY OF THE INVENTION

The invention is in the field of treating a substance such as a gas with an energizer such as RF energy to change its state and specifically pertains to the use of RF energy to transition a gas under controlled conditions to a new state.

It is known that gas can be treated with energy such as RF energy to heat or ionize the gas, and effects such as glow discharge and transitioning to plasma states are known. While a special form of lightning called ball lightning appears to have some of the characteristics of gas plasma it also has other characteristics that appear to be different from those of the known gas plasmas and appear to contradict some accepted principles of physics. For example, it is reported that a naturally occurring ball in the form of a glowing fireball has been observed to last for many seconds, to persist in a shielded environment and to have other unusual properties. See, e.g.: Johnson, P. O., "Ball Lightning and Self Containing Electromagnetic Fields," Am. J. Phys. 33, 119 (1965); Singer, S., "The Nature of Ball Lightning," Plenum Press, New York (1971); King, M. B., "Tapping the Zero-Point Energy," 1989, pp. 7–10 (Paraclette Publishing, P. O. Box 859, Provo, UT 84603); and Secor, H. W., "The Tesla High Frequency Oscillator," Electrical Experimenter 3, 615 (1916). Some publications discuss energy relationships that may be relevant to some ball lightning characteristics. See, e.g.: Puthoff, H. E., "Gravity as a Zero-Point Fluctuation Force," Phys. Rev. A39(5), 2333 (1989); Hirichi, R. et al., "Three-Dimensional Self-Organization of a Magnetohydrodynamic Plasma," Phys. Rev. Lett. 55 (2), 211–213 (1985); King, M. B., "Macroscopic Vacuum Polarization," Proceedings of the Tesla Centennial Symposium, International Tesla Society, Colorado Springs, pp. 99–107 (1984); Boyer, T. H., "Random Electrodynamics: The Theory of Classical Electrodynamics with Classical Electromagnetic Zero-point Radiation," Phys. Rev. D11, No. 4. 790 (1975); and Senitzky, I. R., "Radiation-Reaction and Vacuum Field Effects in Heisenberg-Picture Quantum Electrodynamics," Phys. Rev. Lett. 31 (15) 955 (1973).

While there has been a significant interest in ball lightning, it is believed that significant aspects of the nature and characteristics of the phenomenon have remained largely unexplained by accepted principles of physics and that no effective way had been found to reliably reproduce at least some of the unique effects of the phenomenon. The invention is directed to this perceived need to reproduce some of these effects and exploit them.

In an exemplary and non-limiting embodiment of the invention, at least some of the effects of the ball lightning phenomenon are created by generating a glow discharge at the free end of a waveguide in a vacuum vessel containing a gas at an initial pressure below atmospheric by feeding RF energy at a frequency above about 1 MHz to said waveguide, then gradually increasing the gas pressure while continuing to feed the same RF energy to the waveguide until the glow discharge transitions to a new state in which the average internal temperature of the gas at the free end of the waveguide is at least an order of magnitude higher than that of the glow discharge, and maintaining that new state of the gas for a period of the order of at least tens of seconds. The initial gas pressure can be of the order of $10^{-1}$ mbar; it is increased gradually to the range of about 20–100 mbar and preferably 20–40 mbar. The RF energy can be at about 27.12 MHz.

It is believed that the process involves causing the gas first to transition to a glow discharge state in which the electron-free positive ions of the gas are above the boundary $R_{k,p}=(2)(10^{-16})/E$, where $R_{k,p}$ is the spacial distance in cm between adjacent electron-free positive ions in the gas which is in the glow discharge state and E is the energy in Erg of an electron-free positive ion, and then causing the gas to transition to a new state in which a sufficient number of the electron-free positive ions are below the boundary $R_{k,p}$ to substantially increase the average internal temperature of the gas, and then maintaining that new state for a period of the order of at least tens of seconds. While this is the explanation of the phenomenon in which the inventor believes, it may turn out that a different theory of operation is more accurate or is the only accurate theory. However, the invention disclosed and claimed herein is not limited to or by any particular theory of operation but is defined only by the scope of the appended claims.

DETAILED DESCRIPTION

Figure 1:
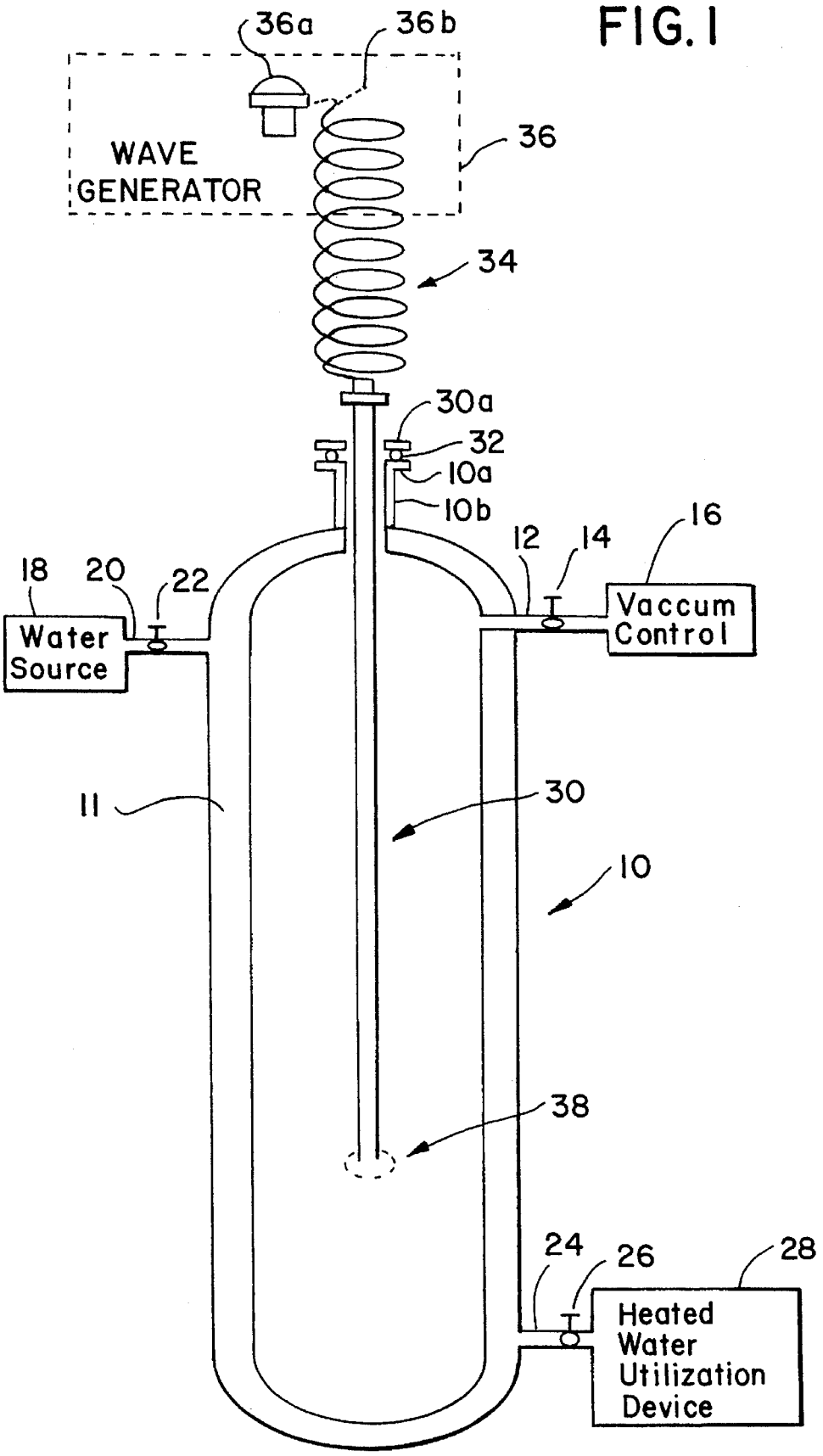
FIG. 1 is partly a sectional view and partly a block diagram illustrating an embodiment of the invention.

Referring to FIG. 1, a double wall vacuum vessel 10 of a material such as quartz glass is connected via a conduit 12 to a vacuum pump and control unit 16 through a vacuum valve 14 so that the gas pressure in the interior of vessel 10 can be brought down to and kept at a desired point in the range of about $10^{-1}$–$10^{2}$ mbar (millibar). Water or some other heat transferring fluid from a source 18 passes through a conduit 20 controlled by a valve 22, flows through the space between the two walls of vessel 10, exits through a conduit 24 controlled by a valve 26 and enters a utilization device 28 such as a heat exchange water heater. A waveguide 30 extends axially into vessel 10 such that its free end is about two-thirds down into vessel 10. A flange **30*a* of waveguide 30 presses against a flange 10*a* of the neck 10*b* of vessel 10 through a gasket 32 to ensure a gas-tight fit. An antenna 34 is coupled to waveguide 30 to deliver thereto RF energy generated by microwave generator 36 which includes an output tube 36*a* delivering RF energy to a radiating strip 36*b* transferring RF energy to an antenna 34. In an exemplary sequence illustrating the invention, vacuum control 16 and valve 14 are operated to reduce the gas pressure inside vessel 10 to about $10^{-1}$ mbar. The gas can be room air or a gas such as hydrogen or helium. Generator 36 is turned on to output RF energy at a frequency of about 27.12 MHz. Through the tuned system of output tube 36*a*, strip 36*b*, antenna 34 and waveguide 30, this RF energy is delivered to the free end of waveguide 30 to transition the gas at a region 38 (which is not shown to scale in FIG. 1) to a reddish-pink glow discharge state in which an emission detector such as a spectrophotometer (not shown) detects light emissions from the glow discharge plasma which have distinct lines characteristic of the gas in vessel 10. This state is maintained for a minute or two, and then control 16 and valve 14 are operated to gradually increase the pressure in vessel 10 until the gas at region 38 changes to a new state in which a spectrophotometer detects emissions which have substantially less distinct lines, i.e., it detects essentially a continuum of light emission frequencies. At lower pressures in vessel 20, region 38 when in the new state is typically red, and moves through yellow and green to white as the pressure is increased to about 40 mbar. Increasing the pressure further appears to increase the average internal temperature of region 38. At pressure of in the range of 100 mbar and above, it appears that region 38 becomes so hot that it melts the equipment. However, at pressures in the range of about 20–40 mbar, it is possible to maintain the region 30 in the new state for long periods, of the order of at least hours. Heat is transferred from region 38 when in the new state to waveguide 30 through the contact of region 38 with the free end of waveguide 30 and, moreover, heat is transferred from region 38 to gas molecules that come in contact with it or pass through it. Waveguide 30 is made of a heat conductive material and radiates heat which in turn heats the internal wall of vessel 10 and the water flowing through the space between the walls of vessel 10**.

A significant jump in transfer of heat from the gas at region 38 to waveguide 30 and to the interior wall of vessel 10 and thus to the heat-transfer liquid 11 in the space between the walls of vessel 10, appears to take place when the gas at region 38 transitions from the glow discharge state to the new state. However, it appears that the only significant transfer of heat from region 38 when in the new state, takes place by conducting heat through the contact of the gas at region 38 with the free end of waveguide 30 and with gas molecules in contact with or passing through region 38; little or no transfer of heat appears to take place by radiation from region 38 when in the new state to the walls of vessel 10 or to liquid 11. When all relevant parameters are the same, i.e., power drawn from generator 36 and the flow rate of water 11 through the space between the walls of vessel 10, the heat energy delivered by water 11 to device 28 can be approximately doubled. It is believed that the average internal temperature at region 38 in the new state is at least an order of magnitude higher than that of the glow discharge state.

In one experimental arrangement, the external diameter of vessel 10 is about 160 mm and the internal diameter about 120 mm. The space between the walls is between 10 and 20 mm, the internal wall is about 3 mm thick and the external wall can be the same or thinner. The axial dimension of vessel 10 is about 500 mm. The material of vessel 10 is quartz glass capable of withstanding about 1500 degrees C. Waveguide 30 is made of a material such as Ni—Cr steel and is a thin wall tube about 12 mm in diameter. Antenna 34 can be about 10–12 turns of copper wire, about 2 mm thick, wound such that the antenna diameter is about 120 mm and the axial length is about 500 mm. Generator 36 can be vacuum tube microwave generator having an input power rating of about 6 KW and an output rating of about quarter that, i.e., about 2 KW.

It is believed that the gas at region 38 when in the new state has at least some of the characteristics ascribed to the ball lightning phenomenon. For example, it persists for periods of the order of at least tens of seconds (in fact many hours or perhaps indefinitely so long as the necessary conditions are maintained), it appears to have a high internal temperature, and it appears to transfer large amounts of heat through contact with a heat conducting body but very little or no heat through radiation.

Figure 2:
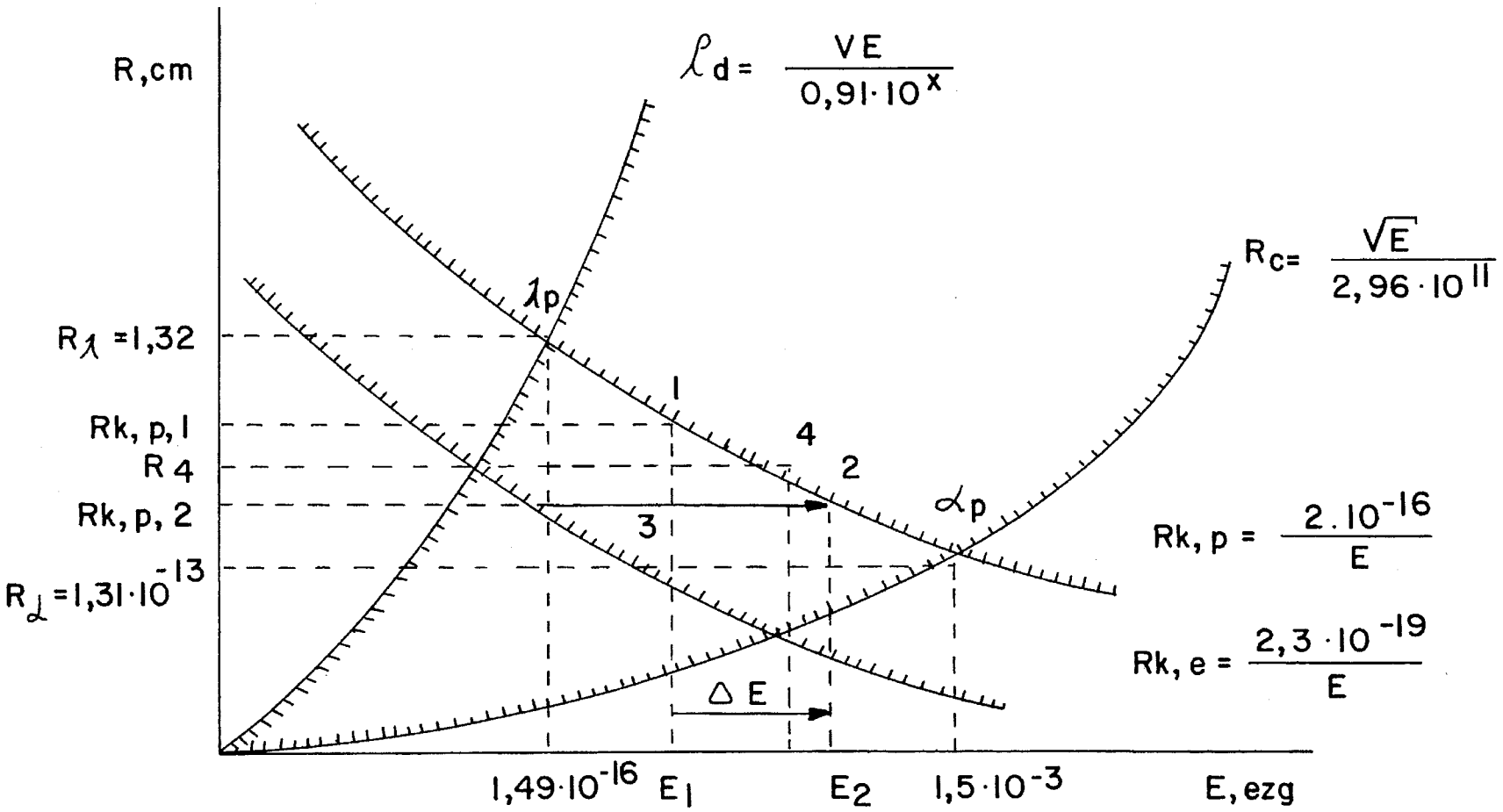
FIG. 2 shows graphs useful is setting forth an explanation of the phenomenon taking place in the embodiment illustrated in FIG. 1.

While the invention is not limited to any particular explanation of these effects or by any particular theory, the inventor's belief is that the ball lightning effects of the new state at region 38 are due to placing the gas at a point state below a quantum boundary from which it spontaneously moves back to that boundary and thereby gains energy from what some of the physics literature cited above refers to as zero-point energy. Referring to FIG. 2, where the vertical axis is the spacial distance R in cm between particles such as atoms, or ions, or atomic nuclei, or protons, as the case may be, and the horizontal axis E is the energy of a particle in Erg, the inventor believes that matter such as atoms which have their normal complement of electrons conforms to the currently accepted principles of physics when in the R-E space which is to the right of curve $R_d$, to the left of curve $R_c$ and above curve $R_{k,e}$, but that an atomic nucleus stripped of the electrons of the atom, e.g. a proton, conforms to these accepted laws of physics only when above the boundary $R_{k,p}$ (and between the same left and right boundaries in R-E space). The inventor believes that if the electrons are stripped away from atoms to leave only the atomic nuclei, e.g., only protons, in matter which starts out at a point in R-E space such as point 3 in FIG. 2, the matter will spontaneously move to the right in FIG. 2, from point 3 to the boundary $R_{k,p}$, e.g., at point 2, and to accomplish this move will gain energy (delta E) which comes from a source that does not conform to the currently accepted principles of physics which cannot explain the naturally occurring ball lightning phenomenon. The inventor believes that the equipment and process described in connection with FIG. 1 is a species of the process of placing nuclei stripped of their electrons at a point in R-E space such as point 3 in FIG. 2 and extracting therefrom energy generated spontaneously due to the material's move to the $R_{k,p}$ boundary, e.g., to point 2. The inventor believes that when the gas is at the initial low pressure of about $10^{-1}$ mbar in vessel 10, it is at a point in R-E space such as point 3, at which the atoms or molecules of the gas have their electrons and their behavior conforms to the accepted principles of physics. The RF energy ionizes the gas in region 38 to leave some atomic nuclei free of electrons, but initially they are above the $R_{k,p}$ boundary because the spacial distance R between them is too great. As the pressure in vessel 10 rises, the distance R between electron-free ions decreases, and eventually electron-free nuclei find themselves below the boundary $R_{k,p}$ and spontaneously move to that boundary and in the process generate energies (delta E). Some of this energy is transferred as heat to waveguide 30 as well as to gas molecules in contact with or passing through region 38. Despite the high internal temperature of the gas in region 38 due to this gain of energy, there is little or no radiation of heat because of the nature of the new state at region 38. In accordance with this hypothesis, the energy gain can be achieved when any suitable technique is used to place electron-free positive ions at a point in R-E space such as point 3 in FIG. 2. The inventor has conceived many embodiments of these principles in addition to that of FIG. 1, and has tested some of these different embodiments. It is not entirely clear at this time which may turn out to be preferred for particular end use, but for now the embodiment shown in FIG. 1 is considered as the preferred embodiment for building and testing. Thus, the inventor believes that the invention is not limited to placing gas below atmospheric pressure in the new state in the manner described in detail above, but applies to producing a similar new state in the case of gas at higher pressure as well as in the case of substances in liquid or solid phase. For example, the inventor believes that a liquid phase substance such as liquid hydrogen can be a suitable replacement for the gas in vessel 10, provided that an energizer such as RF energy can concentrate enough energy per unit volume in the desired region to ionize a sufficient number of atoms to electron-free nuclei (protons) and maintain that state for a sufficient period of time to form a region similar in properties to region 38. When a substance such as liquid hydrogen is used, the liquid itself can be used as the heat-transfer medium and there would be no need for a separate heat transfer medium such as liquid 11. Similarly, a solid such as a crystal lattice of Palladium packed with positive hydrogen ions through a process such as electrolysis, can be used in place of the gas discussed above, in which case the solid can be shaped in the form of an RF waveguide concentrating RF energy at a selected region to cause the transition of the hydrogen ions packed in the solid to a new state such as that of the gas at region 38. In place of RF energy, the energizer can be a high-voltage discharge or a high-energy particle beam carrying out the same function as the RF energy discussed above: to place and maintain a sufficient number of electron-free ions below the barrier $R_{k,p}$ to achieve the effects discussed in connection with the gas in the new state at region 38.

I claim:

1. A method comprising:

subjecting a gas which is at a selected pressure to RF energy which is at a frequency greater than 1 MHz to cause a transition of the gas to a glow discharge state in which the electron-free positive ions of the gas are above a selected boundary $R_{k,p}=(2)(10^{-16})/E$, where R is the distance in cm in space between adjacent ones of the electron-free positive ions and E is the energy in Erg of an electron-free positive ion;

increasing the gas pressure while continuing to subject the gas to RF energy which is at a frequency above 1 MHz to transition the gas to a new state in which a sufficient number of the electron-free positive ions are below the boundary $R_{k,p}$ to thereby substantially increase the average internal temperature of the gas; and maintaining said new state of the gas for a period of the order of at least tens of seconds.

2. A method comprising:

subjecting a gas which is at a selected initial pressure to RF energy which is at a frequency greater than 1 MHz to cause a transition of a gas region to a glow discharge state;

increasing the gas pressure while continuing to subject the gas to RF energy which is at a frequency above 1 MHz, to cause a transition, generally at the same gas region, to a new state at which the average internal temperature of the region is at least an order of magnitude higher than in the glow discharge state but the RF energy delivered to the gas is not substantially higher than that used to maintain the glow discharge state; and maintaining said new state of the gas for a period of the order of at least tens of seconds.

3. A method as in claim 2 in which said initial pressure is of the order of $10^{-1}$ mbar and said increasing step increases the pressure to the range of about 20–100 mbar.

4. A method as in claim 3 in which the RF energy is at a frequency of about 27.12 MHz.

5. A method as in claim 4 including the step of extracting heat energy transferred from the gas in said new state to a heat conducting object contacted by the gas which is in the new state.

6. A method comprising:

generating a glow discharge at the free end of a waveguide in a vacuum vessel containing a gas at an initial pressure below atmospheric by feeding RF energy at a frequency above about 1 MHz to said waveguide;

increasing the gas pressure in the vacuum vessel while maintaining said feeding of RF energy at a frequency above about 1 MHz to said waveguide until the glow discharge transitions to a new state in which the average internal temperature of the gas at the free end of the waveguide is at least an order of magnitude higher than that of the glow discharge; and maintaining said new state of the gas for a period of the order of at least tens of seconds.

7. A method as in claim 6 in which said initial pressure is of the order of $10^{-1}$ mbar and said increasing step increases the pressure to the range of about 20–100 mbar.

8. A method as in claim 7 in which the RF energy is at a frequency of about 27.12 MHz.

9. A method as in claim 8 including the step of extracting heat energy transferred by the gas in said new state to the waveguide by contact between the waveguide and the gas in the new state.

10. A method as in claim 6 in which when the gas is in the glow discharge state the electron-free positive ions of the gas are above a selected boundary $R_{k,p}=(2)(10^{-16})/E$, where R is the distance in cm in space between adjacent ones of the electron-free positive ions and E is the energy in Erg of an electron-free positive ion, but when the gas is in said new state a sufficient number of the electron-free positive ions are below the boundary $R_{k,p}$ to substantially increase the average internal temperature of the gas.

* * * * *